United States Patent [19]

McCoy et al.

[11] 4,020,894

[45] May 3, 1977

[54] PISTON MOLDING MACHINE

[75] Inventors: Frank L. McCoy, Troy; Earl R. King, Ferndale, both of Mich.

[73] Assignee: American Chain & Cable Company, Inc., Bridgeport, Conn.

[22] Filed: Mar. 19, 1976

[21] Appl. No.: 668,438

[52] U.S. Cl. ..... 164/343; 164/DIG. 8; 249/162; 249/170

[51] Int. Cl.[2] ..... B22D 15/02; B22D 17/26

[58] Field of Search ..... 164/DIG. 8, 342, 343; 249/161, 162, 170

[56] References Cited

UNITED STATES PATENTS

| | | | |
|---|---|---|---|
| 22,091 | 11/1858 | Shinn | 249/170 |
| 594,494 | 11/1897 | Sohnehen | 249/170 X |
| 714,061 | 11/1902 | Szekely | 249/161 X |
| 1,598,797 | 9/1926 | Wood | 249/170 X |
| 1,764,889 | 6/1930 | Redmond | 164/DIG. 8 |
| 2,065,287 | 12/1936 | Nutt | 164/343 X |
| 2,521,520 | 9/1950 | Jancuro | 249/162 X |
| 3,171,163 | 3/1965 | Ford et al. | 249/170 UX |

FOREIGN PATENTS OR APPLICATIONS

| | | | |
|---|---|---|---|
| 463,519 | 2/1914 | France | 249/170 |

*Primary Examiner*—Ronald J. Shore
*Attorney, Agent, or Firm*—Barnes, Kisselle, Raisch & Choate

[57] ABSTRACT

A piston molding machine comprising a base on which a pair of mold supports are mounted for movement in a straight line toward and away from one another. A mold half is mounted on each support, and when the mold halves are juxtaposed they provide a cavity for forming a piston. A mold cap is pivoted to each mold half about a transverse axis rearwardly of the face of the mold half. A piston motor extends between each cap and its respective mold support for pivoting the mold cap into position adjacent the mold half to define the top of the cavity and away from the mold half to provide clearance for removal of a piston formed in the mold.

14 Claims, 4 Drawing Figures

PISTON MOLDING MACHINE

This invention relates to piston molding machines.

BACKGROUND OF THE INVENTION

In piston molding machines, it is common to provide mold supports for supporting mold halves that are movable in a straight line toward and away from one another such that when the mold halves are juxtaposed, a mold cavity is provided for forming a piston.

In the manufacture of pistons which have ends with a complex configuration, as is now being used or is contemplated for internal combustion engines, it has been found that it is difficult, if not impossible, to remove the piston from the mold.

Accordingly, among the objects of the invention are to provide a piston molding machine which has a construction that facilitates removal of the piston; which construction is relatively inexpensive; which incorporates structure whereby a conventional machine can be modified for use with or without complex mold configurations.

SUMMARY OF THE INVENTION

In accordance with the invention, a mold cap is pivoted to each mold half about a transverse axis rearwardly of the face of the mold half, and means extending between each cap and its respective mold support for pivoting the mold cap into position adjacent the mold half to define the top of the cavity and away from the mold half to provide clearance for removal of a piston formed in the mold.

DESCRIPTION

Figure 1:
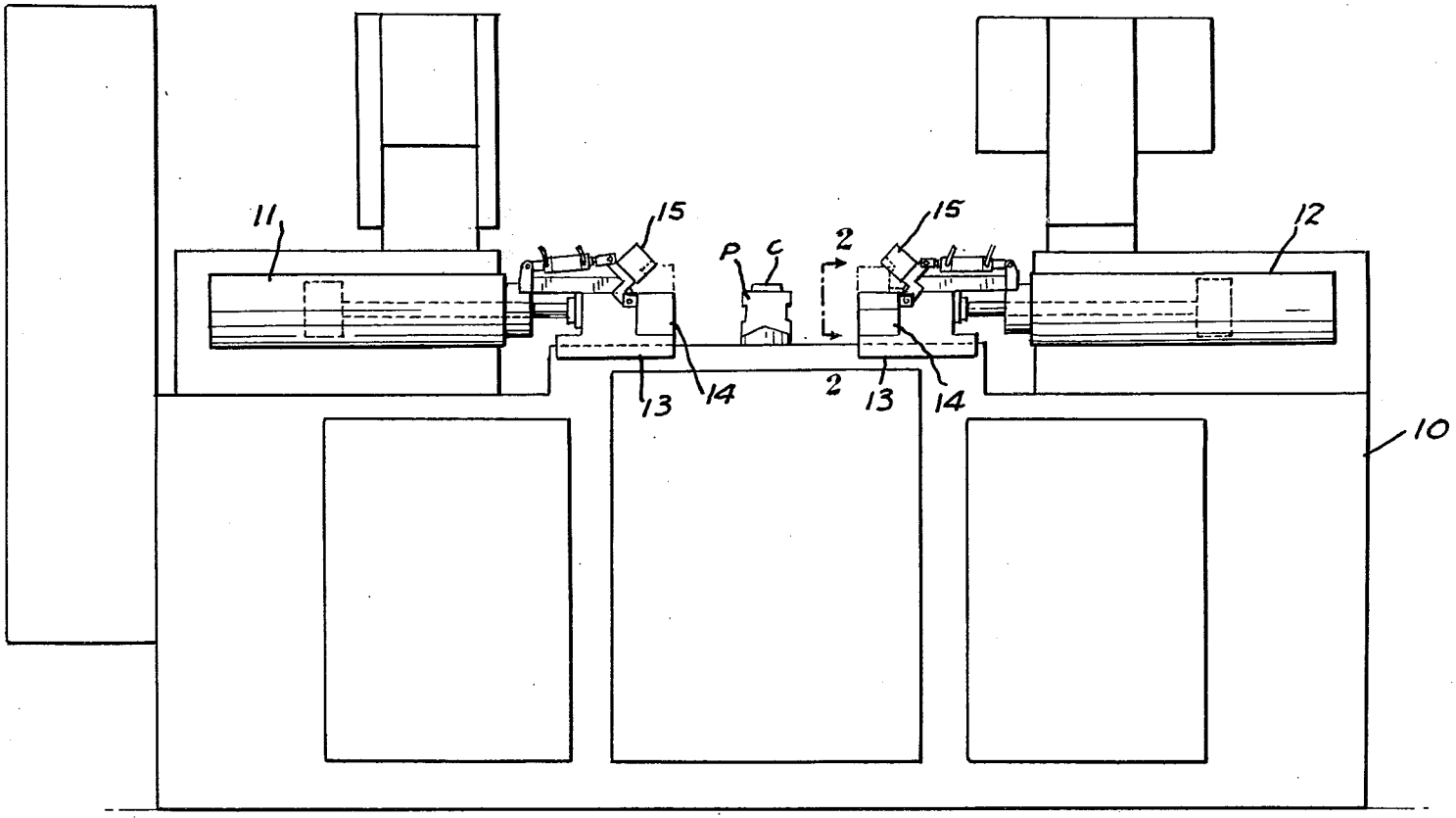
FIG. 1 is a side elevational view of a machine embodying the invention.
Figure 2:
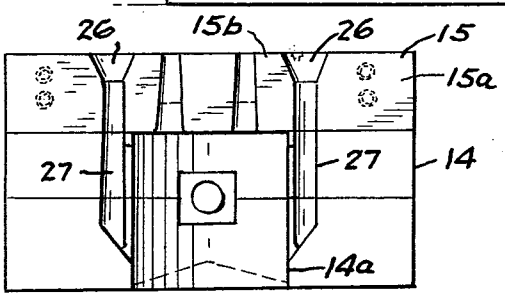
FIG. 2 is a view on an enlarged scale taken along the line 2—2 in FIG. 1.

Referring to FIG. 1, a conventional piston molding machine for molding a piston P of metal comprises a base 10 on which mold supports 13 are mounted for horizontal straight line movement toward and away from one another. The mold supports 13 are moved by piston motors 11, 12 toward and away from one another and cooperate with a core C.

In accordance with the invention, each mold support 13 supports a mold half 14. The mold halves 14 have a surface configuration such that when the juxtaposed surfaces are adjacent one another, a cavity 14*a* is defined.

In accordance with the invention, a mold cap 15 is pivoted about a transverse axis to the mold half 14. Specifically, spaced brackets 16 are bolted to the rear of the mold cap 15 and include a portion extending adjacent a bracket 17 on the rear of the mold half 14. A pin extends between the brackets to pivot the mold cap 15 to the mold half 14. The mold half 14 includes a flat top 14*c* that is engaged by a flat bottom surface 15*c* on the mold cap. When juxtaposed, the mold caps 15 have flat coplanar end surfaces 15*a* and cavities 15*b* that define the configuration of the top of the piston cavity.

Figure 3:
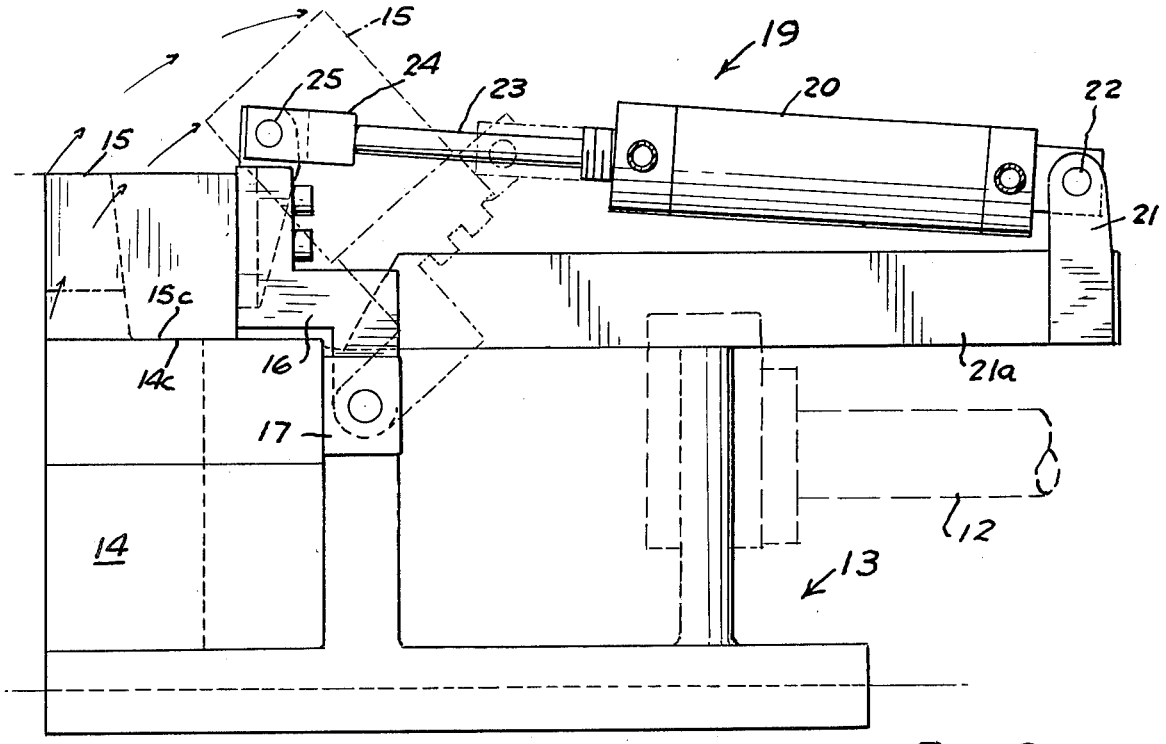
FIG. 3 is a side elevational view on an enlarged scale of a portion of the machine shown in FIG. 1 with the parts in a different operative position.
Figure 4:
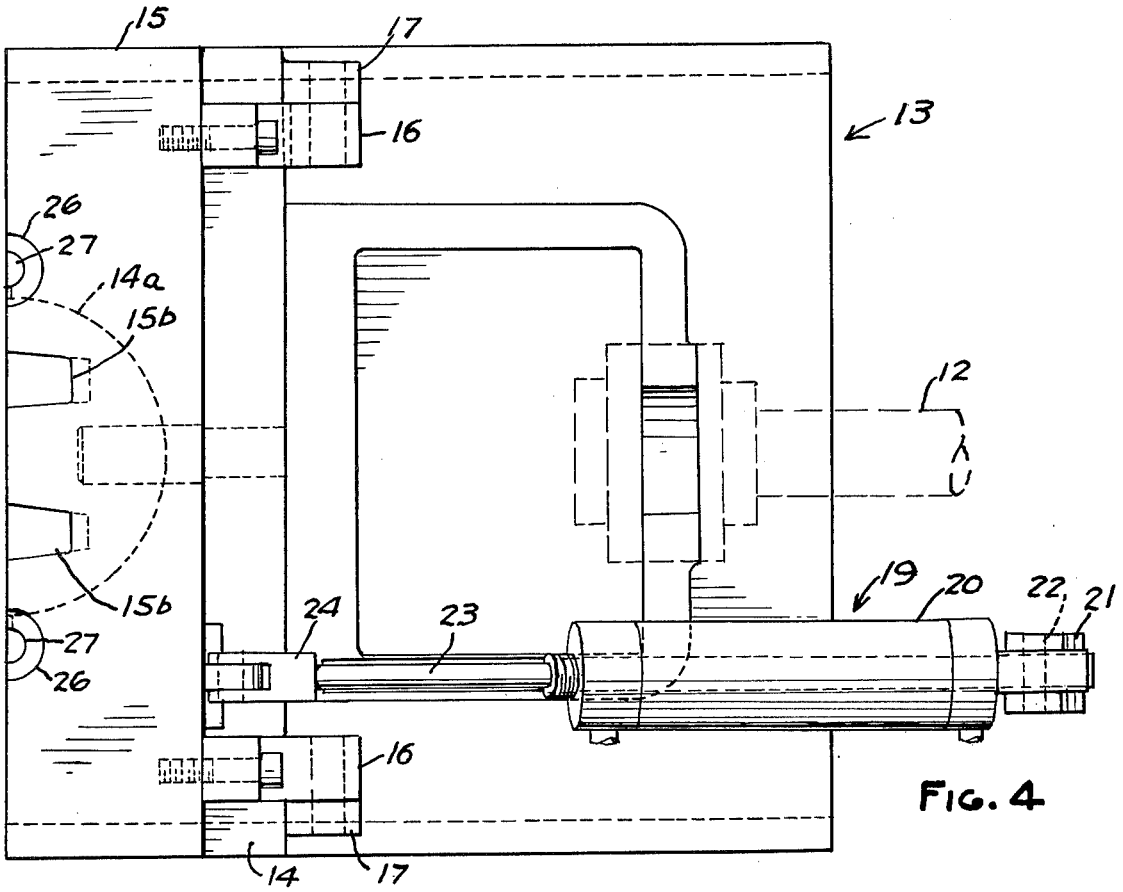
FIG. 4 is a plan view of a portion of the machine shown in FIG. 3.

The mold cap 15 is pivoted to and from the broken line position as shown in FIG. 3 by a cylinder motor 19 which includes a cylinder 20 pivoted by a pin 22 to a bifurcated bracket 21 on an arm 21*a* that is fixed to the mold support 13 by bolts. Shaft 23 of the motor 19 has a clevis that is pivoted to the upper end of the bracket 16 by pin 25.

In practice, the mold halves are brought together by actuation of the motors 11, 12 with the caps 15 in their position adjacent the mold halves. The molten metal is then introduced through the passages 26, 27 to cast the piston. After the piston is cast, the mold caps 15 are pivoted to the solid line position shown in FIG. 1 (broken line position shown in FIG. 3) and then the mold supports 13 are retracted permitting removal of the piston P. The core C is also retracted in accordance with conventional construction.

It can thus be seen that there has been provided a piston casting machine that will permit casting of a complicated configuration on the end of the piston.

The invention can be readily adapted to conventional constructions since all that is required is the addition of the mold caps 15, brackets 16, 17, and piston motor 19 with associated bracket 21 and arm 21*a.*

We claim:

1. In a piston molding machine, the combination comprising a base, a pair of mold supports mounted on said base for movement in a straight line toward and away from one another, means for moving said mold supports toward and away from one another, a mold half mounted on each support, said mold halves when juxtaposed providing a cavity for forming a piston, a mold cap pivoted to each mold half about a transverse axis rearwardly of the face of the mold half, and means extending between each cap and its respective mold support for pivoting said mold cap into position adjacent the mold half to define the top of the cavity and away from the mold half to provide clearance for removal of a piston formed in the mold.

2. The combination set forth in claim 1 wherein said means for moving said mold supports toward and away from one another comprises a cylinder motor individual to each said mold support and mounted on said base.

3. The combination set forth in claim 1 wherein said means for pivoting said cap comprises a cylinder motor individual to each mold cap having a shaft pivoted to said mold cap and a cylinder pivoted to said mold support.

4. The combination set forth in claim 3 wherein said means pivoting said shaft to said mold cap comprises a bracket removably mounted on said mold cap.

5. The combination set forth in claim 1 wherein said mold half and respective mold cap have complementary flat bottom and top surfaces, respectively.

6. The combination set forth in claim 1 wherein said means for pivoting said mold cap to said mold half comprises a bracket removably mounted on said mold cap.

7. In a piston molding machine, the combination comprising a base, a pair of mold supports mounted on said base for movement in a straight line toward and away from one another, means for moving said mold supports toward and away from one another, a mold half mounted on each support, said mold halves when juxtaposed providing a cavity for forming a piston, a mold cap pivoted to each mold half about a transverse axis rearwardly of the face of the mold half, and means extending between each cap and its respective mold support for pivoting said mold cap into position adjacent the mold half to define the top of the cavity and away from the mold half to provide clearance for removal of a piston formed in the mold, said means for pivoting said cap comprising a cylinder motor having a shaft pivoted to said mold cap and a cylinder pivoted to said mold support.

8. The combination set foth in claim 7 wherein said mold half and respective mold cap have complementary flat bottom and top surfaces, respectively.

9. The combination set forth in claim 8 wherein said means pivoting said shaft to said mold cap comprises a bracket removably mounted on each said mold cap.

10. In a piston molding machine, the combination comprising a base, a pair of mold supports mounted on said base for movement in a straight line toward and away from one another, means for moving said mold supports toward and away from one another, a mold half mounted on each support, said mold halves when juxtaposed providing a cavity for forming a piston, a mold cap for each mold half, means for pivotally connecting each said mold cap to its respective mold half about a transverse axis rearwardly of the face of the mold half, and means adapted to extend between each cap and its respective mold support for pivoting said mold cap into position adjacent the mold half to define the top of the cavity and away from the mold half to provide clearance for removal of a piston formed in the mold.

11. The combination set forth in claim 10 wherein said means for moving said mold supports toward and away from one another comprises a cylinder motor individual to each said mold support.

12. The combination set forth in claim 10 wherein said means for pivoting said cap comprises a cylinder motor having a shaft pivoted to said mold cap and a cylinder pivoted to said mold support.

13. The combination set forth in claim 12 wherein said means pivoting said shaft to said mold cap comprises a bracket removably mounted on said mold cap.

14. In a piston molding machine, the combination comprising a base, a pair of mold supports mounted on said base for movement in a straight line toward and away from one another, means for moving said mold supports toward and away from one another, a mold half mounted on each support, said mold halves when juxtaposed providing a cavity for forming a piston, the method of converting said machine to cast pistons having a configuration on the end thereof comprising pivoting a mold cap to each mold half about a transverse axis rearwardly of the face of the mold half, and providing means extending between each cap and its respective mold support for pivoting said mold cap into position adjacent the mold half to define the top of the cavity and away from the mold half to provide clearance for removal of a piston formed in the mold.

* * * * *